US008443902B2

(12) United States Patent
Evans

(10) Patent No.: US 8,443,902 B2
(45) Date of Patent: May 21, 2013

(54) TIME-CONTROLLED RELEASE DEVICE FOR WIRELINE CONVEYED TOOLS

(75) Inventor: Robert W. Evans, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 790 days.

(21) Appl. No.: 12/490,068

(22) Filed: Jun. 23, 2009

(65) Prior Publication Data

US 2010/0319930 A1 Dec. 23, 2010

(51) Int. Cl.
*E21B 19/00* (2006.01)

(52) U.S. Cl.
USPC ..... 166/377; 166/383; 166/153; 403/16

(58) Field of Classification Search
USPC ..... 166/377, 383, 154, 243, 301, 178; 403/16
See application file for complete search history.

(56) References Cited

U.S. PATENT DOCUMENTS

| | | | | |
|---|---|---|---|---|
| 4,909,321 | A | 3/1990 | Petree | |
| 4,997,041 | A | 3/1991 | Petree | |
| 5,109,921 | A | 5/1992 | Aracena | |
| 5,232,060 | A | 8/1993 | Evans | |
| 5,363,921 | A | 11/1994 | Mendez | |
| 5,568,836 | A | 10/1996 | Reid | |
| 6,032,733 | A | 3/2000 | Ludwig et al. | |
| 6,290,004 | B1 | 9/2001 | Evans | |
| 6,386,545 | B1 | 5/2002 | Evans | |
| 6,481,495 | B1 | 11/2002 | Evans | |
| 6,988,551 | B2 | 1/2006 | Evans | |
| 7,290,604 | B2 | 11/2007 | Evans | |
| 7,311,149 | B2 | 12/2007 | Evans | |
| 7,510,008 | B2 | 3/2009 | Evans | |
| 7,854,425 | B2 | 12/2010 | Evans | |
| 8,256,509 | B2 | 9/2012 | Evans | |
| 2005/0092484 | A1 | 5/2005 | Evans | |
| 2006/0169456 | A1* | 8/2006 | Evans | 166/301 |

* cited by examiner

*Primary Examiner* — Yong-Suk (Philip) Ro
(74) *Attorney, Agent, or Firm* — Conley Rose, P.C.

(57) ABSTRACT

A time controlled release device for down line tools includes an outer housing, a disconnect housing releasably coupled to the outer housing, and a mandrel extending longitudinally within the outer housing and the disconnect housing. In addition, the device includes a locking collet and a trigger sleeve disposed about the mandrel. Further, the device includes a first biasing spring disposed within the outer housing between the locking collet and a first shoulder of the outer housing. Still further, the device includes a release collet forming a portion of the outer housing at the distal end and a disconnect release sleeve mounted on the mandrel. Moreover, the device includes a second spring disposed within the outer housing between a second shoulder of the outer housing and a pressure piston mounted on the mandrel between the second spring and a shoulder of the mandrel. The pressure piston has a metering orifice therethrough.

21 Claims, 5 Drawing Sheets

TIME-CONTROLLED RELEASE DEVICE FOR WIRELINE CONVEYED TOOLS

BACKGROUND OF INVENTION

1. Field of the Invention

This invention pertains to mechanical devices used in wells such as oil and gas wells. More, particularly, a device is provided for releasing a line supporting a tool in a well from the tool if the tool becomes stuck in the well. A novel release collet mechanism for releasably connecting two members together is also provided.

2. Description of Related Art

A variety of mechanical devices or tools are used in wells, for such purposes as logging the properties of the rock around the well, taking samples of the rock, perforating holes in casing in the well and other purposes. Because of solids accumulating in an open hole or mechanical malfunctions in a cased hole, it may become impossible to retrieve a tool from a well with the line supporting the tool. The line may be a "slick line" or an electric wire line. In this situation it is desirable to release the line from the tool that is lodged in the well.

Different mechanisms have been used for releasing a line from a stuck tool. For example U.S. Pat. No. 5,109,921 discloses a releasable tool with first and second shear pin arrangements. U.S. Pat. No. 5,568,836 discloses a release device having a latch mechanism and a time delay mechanism that is actuated after a time interval has elapsed.

BRIEF SUMMARY OF THE INVENTION

The present invention allows for the disconnection of a tool from a well line after a predetermined force has been applied for a predetermined time. This allows disengagement of the tool to be aborted up until the predetermined time. A locking mechanism may also be applied to prevent inadvertent or premature release of the tool.

BRIEF DESCRIPTION OF THE SEVERAL VIEWS OF THE DRAWING(S)

FIGS. 1*a*, 1*b*, 1*c* and 1*d* illustrate a time delayed release device according to the present invention.

DETAILED DESCRIPTION OF THE INVENTION

Figure 1A:
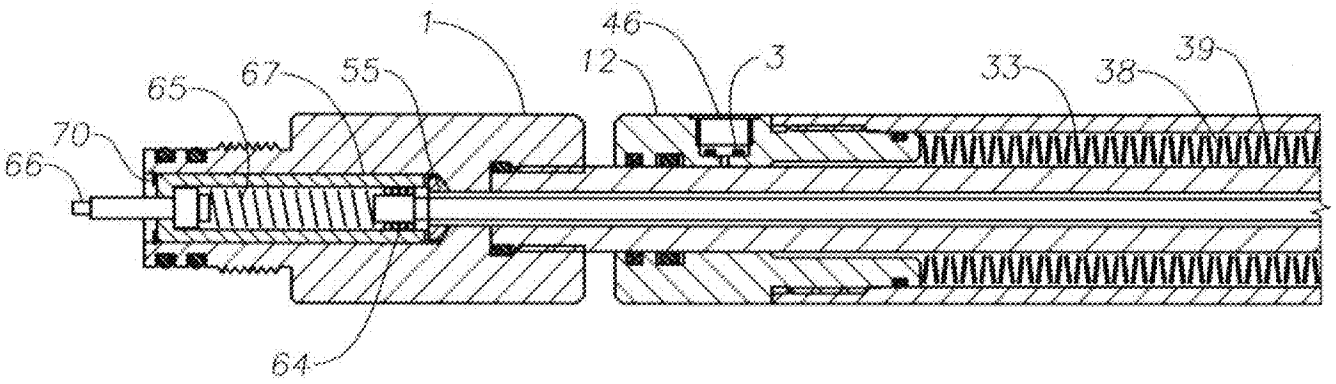

In the following description the term proximal is used to describe the portion of the part being referred to that is closest to the well opening and the term distal is used to refer to the portion of the part that is furthest from the well opening.

Referring to FIGS. 1*a* through 1*d*, there is shown an exemplary embodiment of a time-controlled release devise adapted to be inserted into a wellbore (not shown) according to the present invention. The outer housing or casing includes several different parts that are connected to each other. These include seal housing 12, drive housing 13, collet housing 14, filling sub 15, balance piston housing 17, mud port housing 16, balance housing 8, release collet 31 and releasable housing portions 30 and 2. The mandrel extends longitudinally within the casing and also includes several sections that are connected together. These sections include hammer mandrel 6, collet mandrel 7, balance mandrel 11, and release sleeve mandrel 24.

The proximal portion of the device includes a mandrel connection pin 1 with threads located at its proximal end for securing the device to a wireline connector (not shown). Located partially within the mandrel connection pin is a contact plunger 66 surrounded by an insulating sleeve 67. Ring 70 secures the insulating sleeve within bore in the mandrel connection Pin 1. A spring contact 65 is located within the insulating sleeve and extends between the contact plunger 66 and a contact nut 64 which is secured to a conductor rod 56. The conductor rod is surrounded by a tubular insulating sleeve 60, which may be teflon tubing.

Figure 1B:
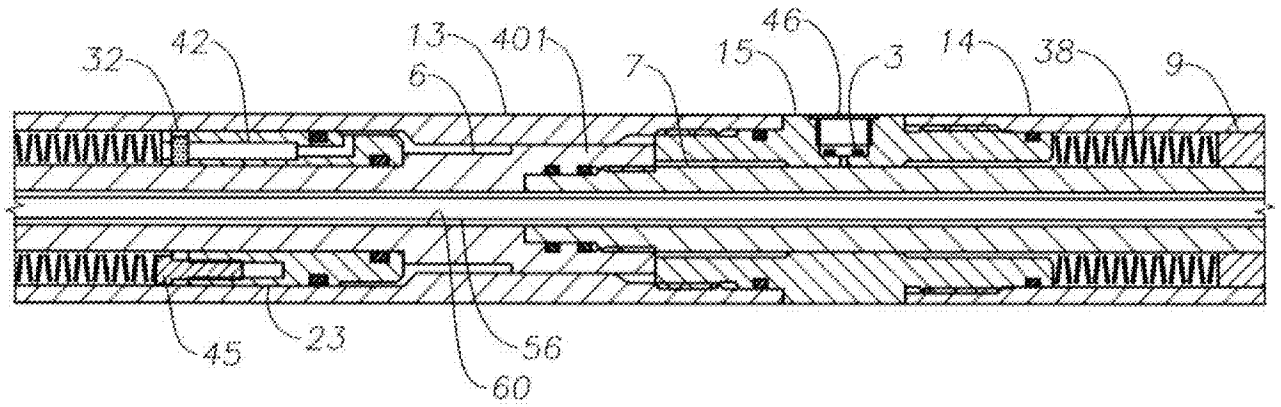
Figure 2:
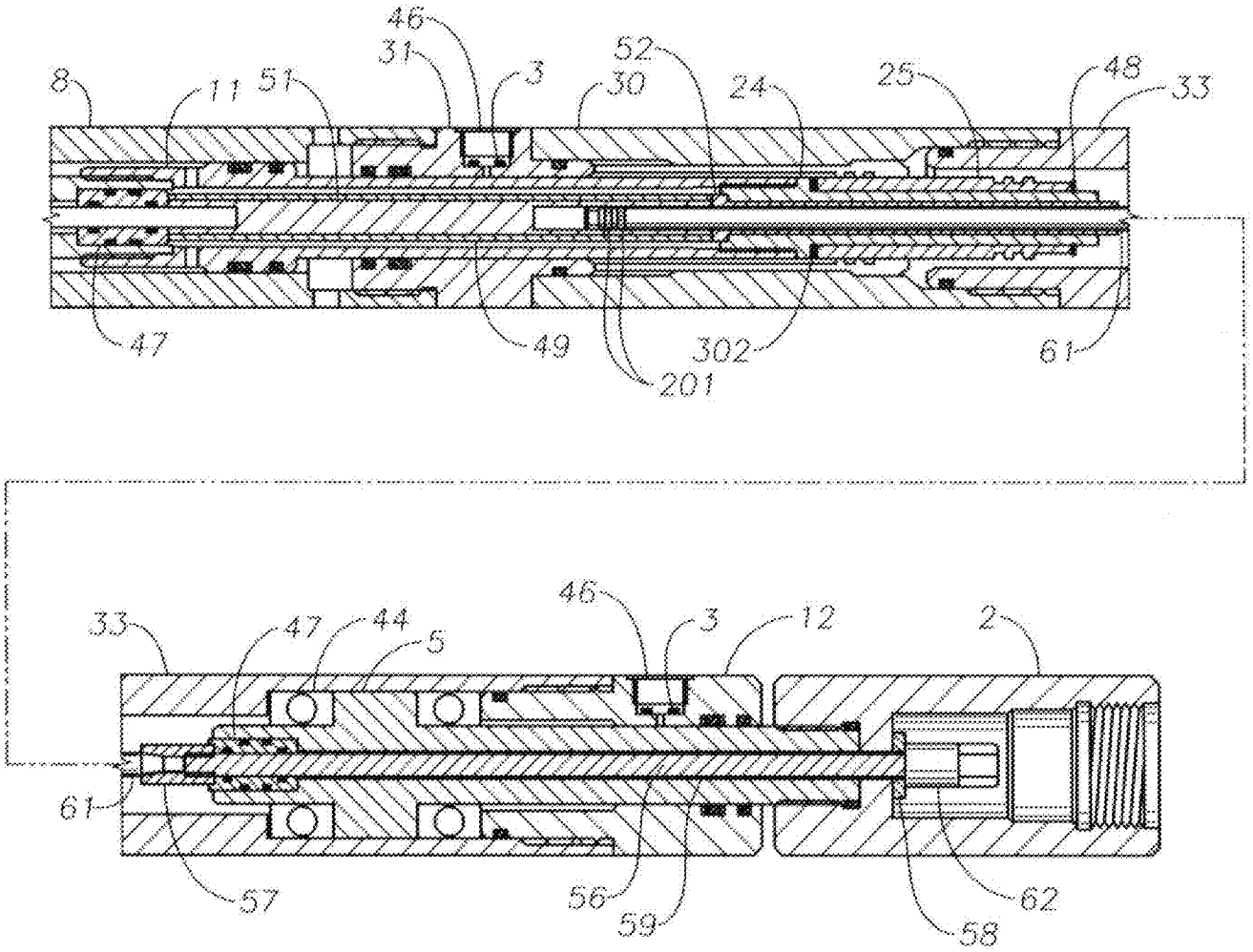
FIG. 2 illustrates an alternative embodiment of the invention used in conjunction with a swivel mechanism for the lower portion of the tool.

An insulator cone 55 surrounds the conductor rod to insulate the contact nut 64 from the mandrel connection pin 1. The distal end of the connection pin 1 has an internally threaded bore which receives the threaded outer portion of a hammer mandrel 6. A drive housing 13 surrounds the mandrel 6 at a first proximal portion as show in FIG. 1*b*. At the proximal portion of the drive housing 13, an externally threaded seal housing 12 is threadedly received by internal threads on the inner surface of the drive housing 13 as shown in FIG. 1*a*. The seal housing includes a seal disc 3 and a jam screw 46 as shown to allow for a fluid to be introduced into the interior of the tool. Located between the drive housing 13 and hammer mandrel 6 is a biasing element shown as a spring 38 comprising a stack of Belleville washers. The spring is initially held in compression between an annular surface on the distal end of seal housing 12 and a pressure piston 23 located within drive housing 13. As can be seen in FIGS. 1*a*, 2 and 1*b*, a hydraulic chamber is formed by the drive housing 13, seal housing 12, and pressure piston 23. The pressure piston includes a metering orifice 42 having a protective filter 32. The piston and orifice act as a time delay as the mandrel moves upward (right to left looking at FIG. 1*b*) as will be explained in more detail.

The hammer mandrel portion 6 has an enlarged diameter section 401 with internal threads that receives an externally threaded portion of a collet mandrel 7. Surrounding the collet mandrel is a filling sub 15, which has external threads extending from opposite ends. The proximal threads are secured to an internally threaded portion of the drive housing 13 and the distal threads are secured to an internally threaded portion of the collet housing 14. Filling sub 15 is provided with another seal disc 3 and jam screw 46 to allow introduction of a fluid to the interior of the release device at this point. A second biasing element shown as a stack of Belleville washers is located between the collet mandrel 7 and the collet housing 14. One end of the biasing element abuts an end face of the filling sub 15 while the other end contacts a compression ring 9 as shown in FIG. 1*b*. A locking collet 20 (FIG. 1*c*) surrounds a portion of the collet mandrel 7 and is in turn surrounded by a trigger sleeve 21 located between the collet housing 14 and the locking collet 20. A portion of collet mandrel 7 is provided with circumferentially extending grooves 402. The details of the locking collet 20 and its operation are described in applicant's U.S. Pat. No. 6,481,495, the contents of which are hereby expressly incorporated herein.

Figure 1C:
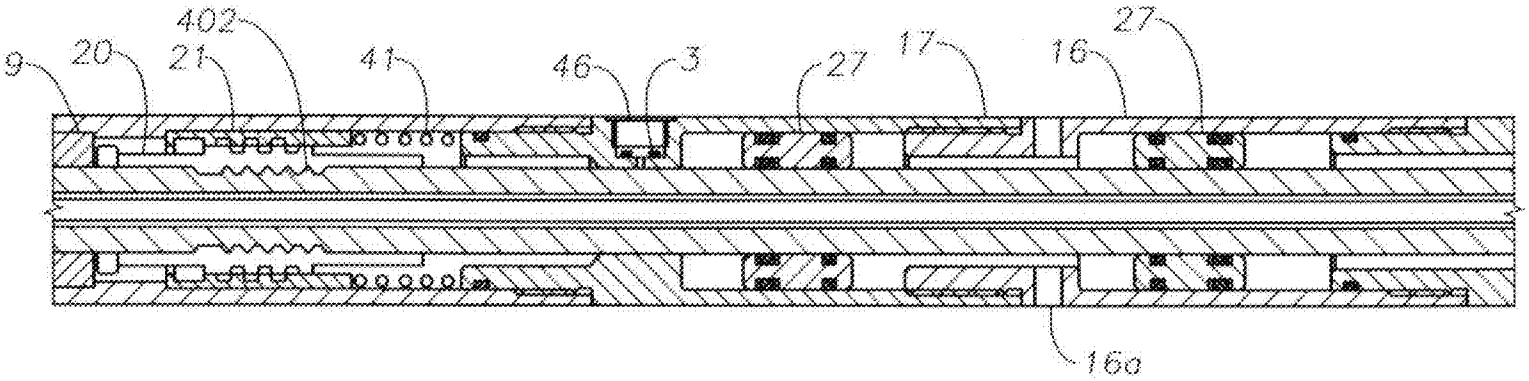

A balance piston housing 17 has a proximal portion externally threaded which engages a distal internally threaded portion of the collet housing 14. The distal portion of the balance piston housing 17 is internally threaded to receive an externally threaded proximal portion of a mud port housing 16. Mud port housing 16 has inlet ports 16*a* to allow liquid within the well to communicate with a chamber formed by opposing end faces of balancing pistons 27 and outer housing sections 17 and 16 as shown in FIG. 1*c*. The distal portion of the mud port housing is internally threaded to receive the proximal portion of balance housing 8.

A first annular fluid chamber is formed between the collet mandrel 7 and balance piston housing 17. Located within this chamber is an annular balance piston 27 which is slidably mounted on the collet mandrel 7. A second fluid chamber is formed between the mud port housing 16 and the collet mandrel as shown in FIG. 1*c* and has located therein a second annular balance piston 27. An annular fluid passage that communicates between the first and second fluid chambers is formed between a reduced diameter portion of the mud port housing 16 and the collet mandrel 7. The balance pistons act to balance pressure differentials due to variances in temperature and compressive pressure along the length of the release device. The details and operation of the balancing piston is fully described in applicant's U.S. Pat. No. 7,290,604, the contents of which is hereby expressly incorporated herein.

Figure 1D:
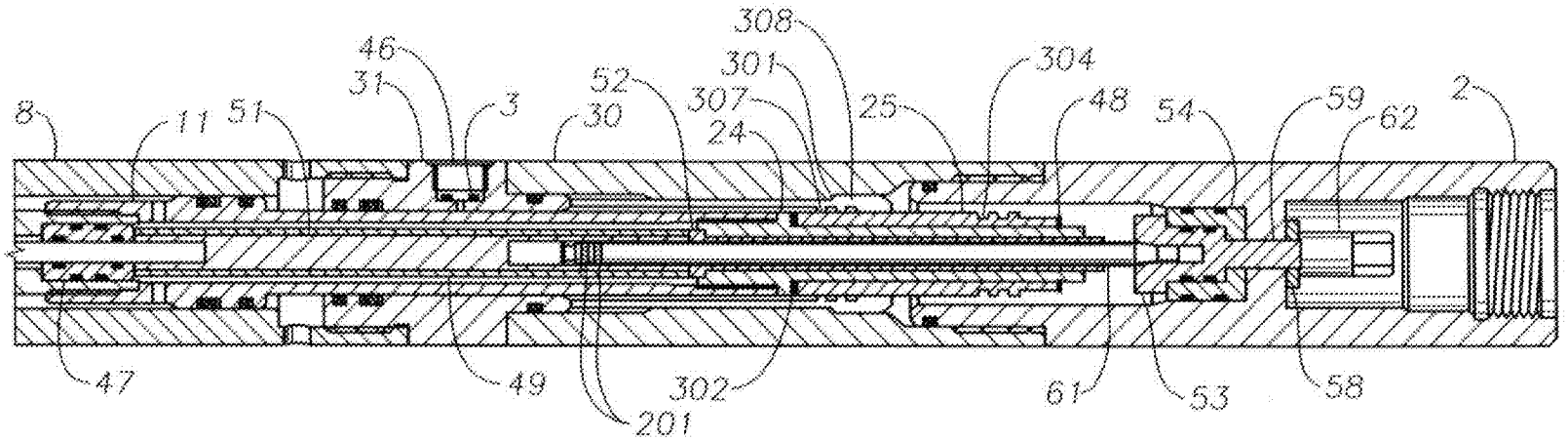
Figure 3:
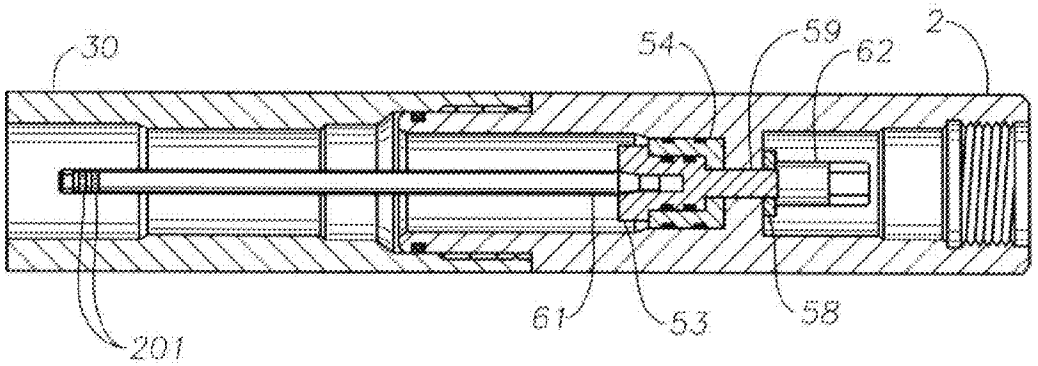
FIG. 3 shows the lower portion of the device that remains in the well after the release mechanism has been actuated.
Figure 5:
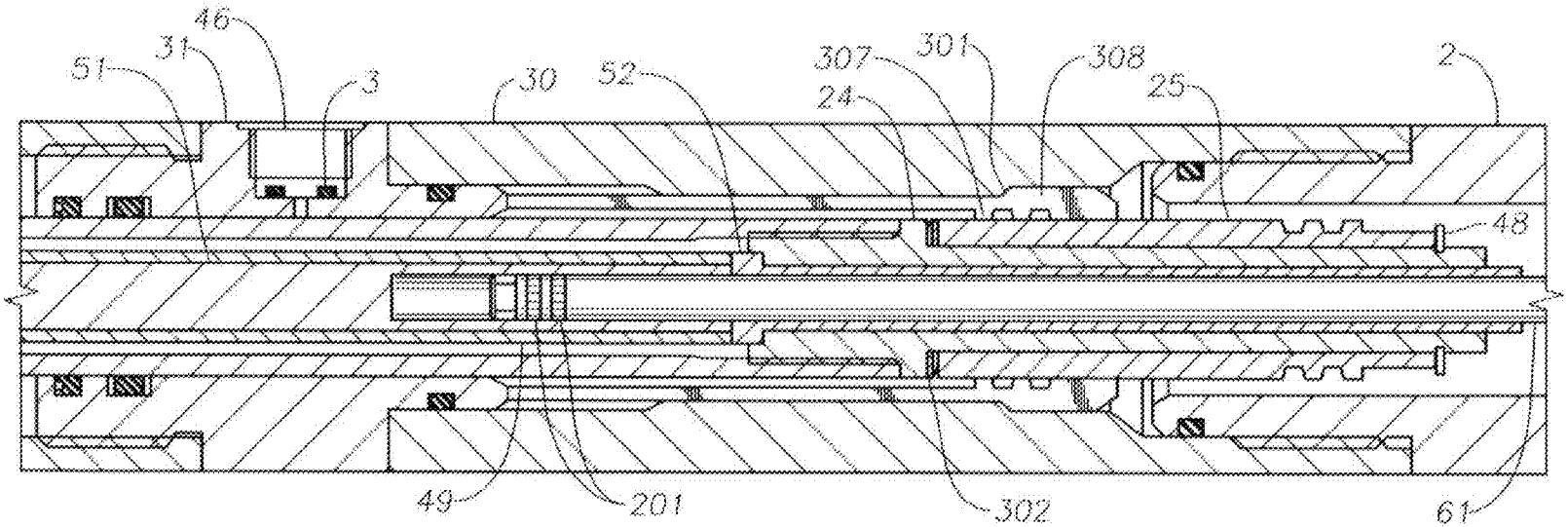
FIG. 5 shows the details of the release collet and sleeve mechanism.

A balance housing 8 having an externally threaded proximal portion is secured to the distal threaded portion of mud port housing 16. A distal portion of the balance housing 8 is internally threaded and receives the proximal externally threaded portion of a release collet 31 as shown in FIG. 1*d*. The distal end portion of the collet mandrel 7 has an externally threaded portion that receives an internally threaded portion of balance mandrel 11, which has a distal internally threaded portion that receives an externally threaded portion of a sleeve release mandrel 24. A release sleeve 25 is slidably mounted on the sleeve release mandrel 24 between a retaining ring 48 and a wave spring 302. The disconnect housing 30 is releasably attached to the release collet as shown in FIG. 1*d*. Release collet 31 has a main body portion with an axial bore extending therethrough. A plurality of axially spaced flexible fingers 308 extend longitudinally from the main body portion. At the end of the fingers are located radially inwardly extending tabs 307 and raised contact shoulders. A release sleeve 25 slides within the axial bore of the collet 31. The sleeve is provided with a plurality of axially spaced grooves 304 that are adapted to receive the tabs 307 located on the fingers of the collet 31. When the sleeve travels a sufficient distance so that the grooves are in alignment with the tabs on the ends of the collet fingers, the fingers flex inwardly due to the forces acting on the raised contact shoulders, thus moving the contact surfaces 308 on the upper portion of the fingers from the contact surface 301 of the disconnect housing, thus allowing the parts retained in place by the contact surfaces to separate. At this point in time the release tool is disengaged from the tool(s) that are connected to the tool at 2. Disconnect housing 30, housing connection housing 2 and sliding contact rod 61 are left behind by virtue of being attached to the down well tool at the internal threads of connection housing 2 as shown in FIG. 3.

Another feature of this invention, although not critical to its operation, is a mechanism that provides an indication that separation is about to occur.

Located within the distal portion of collet mandrel 7 is an insulating bushing 47 for the conductor rod 56 as shown in FIG. 1*d*. The distal end of release collet 31 has a reduced diameter portion over which the proximal portion of disconnect housing 30 is received. The distal portion of disconnect housing has an internally threaded portion that receives an externally threaded portion of housing connection 2. The distal end portion of conductor rod 56 is connected to conductor barrel 51 which is surrounded by an insulating sleeve 49. The distal end of the conductor barrel has an internal bore that receives a sliding contact rod 61, which is connected to the connection housing as discussed below. An insulating sleeve 52 surrounds contact rod 61 and is located within a bore in release sleeve mandrel 24. The proximal end of the sliding contact rod 61 caries two current carrying contact springs 201. Suitable springs are sold by Bal Seal Engineering, Inc. and are known as BAL CONTACT SPRINGS. The downstream end of the sliding contact rod 61 is engaged by a rod holder 53 and by a rod holder and insulating bushing 54. A Teflon insulator tubing 59 is located between the connector housing and the distal portion of rod holder 53. A contact socket 62 is connected to the rod holder 53 to enable electrical connection to the down well tool carried by connector housing 2. An insulating washer 58 is positioned between contact socket 62 and the interior of housing 2 as shown in FIG. 1*d*. As the mandrel moves from right to left in FIG. 1*d*, current carrying contact springs 201, which are in contact with the conductor barrel, will eventually contact insulating sleeve 52, resulting in an open circuit, thus indicating that the release is about to occur. The distance traveled by the springs when they come out of contact with conducting barrel is less than that required for the grooves on the release sleeve 25 to engage the tabs on the flexible fingers of the release collet 31. This enables the operator to continue the release process or abort the process if desired before the release mechanism is actuated.

In operation, force applied in an upward direction on the mandrel will cause the mandrel to move upwardly against the biasing force of the first and second springs and the piston 23 acting on the fluid in the chamber within drive housing 13 as shown in FIG. 1. After an initial force of, for example, 600 pounds, locking collet is moved sufficiently to permit the fingers of the locking collet to flex outwardly, thus allowing the mandrel to disengage from the collet. At this point a force of approximately 750 pounds is applied to the wire. Further movement of the mandrel is now resisted by the first spring and the pressure piston 23. The metering orifice 42 in the piston acts to regulate the amount of time required to have the mandrel move sufficiently for the release collet to be activated. The delay time period can be varied by using orifices of different diameters and springs with different spring constants. When the mandrel has traveled the distance required to allow the grooves 304 in the outer surface of release sleeve 25 to mesh with the interior grooves in the fingers of release collet 31, the fingers on the end of release collet move inwardly. This disengages the shoulders 308 on the fingers from the interior shoulder 301 formed in the bore of housing 30. At this point the upper portion of the device is disengaged from the lower housing section, leaving it attached to the lower tool at 2. Conductor rod connectivity is broken as the mandrel is traveling when current carrying contacts 201 are no longer in contact with conductor barrel 49. This will give the operator an indication that separation is about to occur. Balancing pistons 27 are free to move along the mandrel to compensate for pressure differentials due to temperature differences and the compressive forces acting on the exterior of the tool. External fluid is allowed to enter the space between the two pistons via mud ports 16*a* in housing 16.

Figure 4:
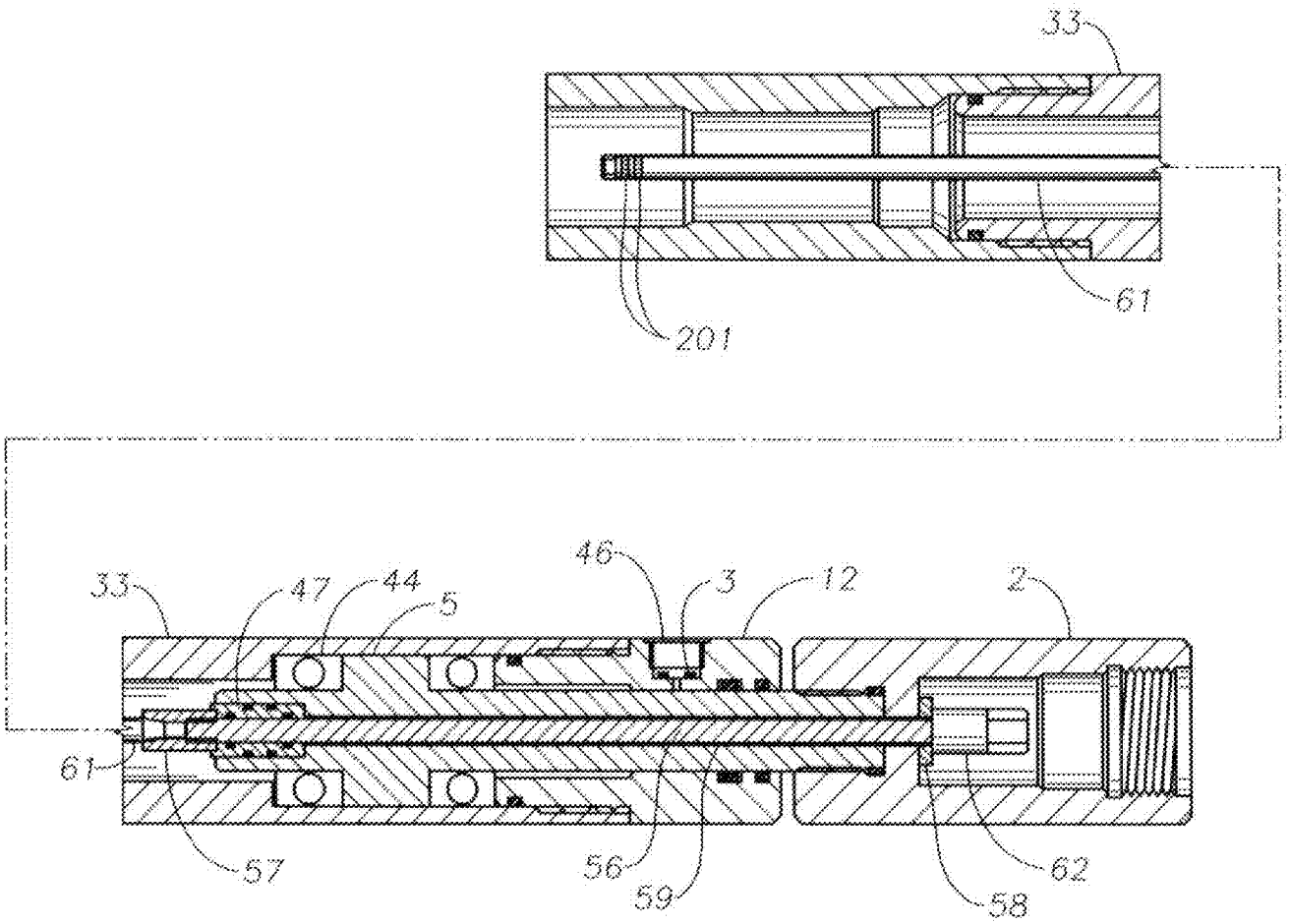
FIG. 4 shows the lower portion of the embodiment shown in FIG. 2 that is left in the well after actuation of the release device.

In some applications it is desirable to provide a swivel connection between the release device and the stuck tool. Such an arrangement is shown in FIG. 2. As show in FIG. 2, a swivel housing 33 is connected to the distal portion of disconnect housing 30 by screw threads. The distal portion of swivel housing 33 is in turn connected to a second seal housing 12. The seal housing is provided with a seal disc and jam screw. Located within the swivel housing is a bearing mandrel 5. Suitable bearings are located between the swivel housing and the bearing mandrel. A connector 57 connects contact rod 61 to conductor rod portion 56. The distal end of bearing mandrel 5 is threadedly attached to the connector housing 2, as shown in FIG. 2. Thus in the embodiment of FIG. 2, the release device is rotatably connected to the down well tool via connector housing 2 and bearing mandrel 5. FIG. 4 illustrates the portion of the release tool that is left in the well after separation of the embodiment of FIG. 2.

Although the present invention has been described with respect to specific details, it is not intended that such details should be regarded as limitations on the scope of the invention, except to the extent that they are included in the accompanying claims.

I claim:

1. A time-controlled release device for wireline conveyed tools comprising:

an outer housing;

a disconnect housing releasably coupled to a distal end of the outer housing;

a mandrel extending longitudinally within the outer housing and the disconnect housing;

a locking collet and a trigger sleeve disposed about the mandrel at a first location;

a first biasing spring disposed within the outer housing between the locking collet and a first shoulder of the outer housing;

a release collet forming a portion of the outer housing at the distal end;

a disconnect release sleeve mounted on and surrounding the mandrel, wherein the release collet has a first position coupling the outer housing and the disconnect housing and a second position allowing the outer housing to decouple from the disconnect housing;

a second spring disposed within the outer housing between a second shoulder of the outer housing and a pressure piston disposed within the outer housing;

wherein the pressure piston is mounted on the mandrel between the second spring and a shoulder of the mandrel, the piston having a metering orifice therethrough, whereby when a given load is exceeded on the line, the locking collet is disengaged and upon further increase in load, the release collet is activated after a predetermined period of time dependent upon the flow resistance of the metering orifice in the piston.

2. The device according to claim 1 and further including a pair of balancing pistons within the housing and mounted on the mandrel.

3. The device according to claim 1 and further including an insulated connector rod extending within the housing, a sliding contact rod received within a bore located in a distal end of the insulated connector rod, and current carrying contacts secured to the outer surface of the sliding contact rod.

4. A device according to claim 1 and further including a bearing mandrel located within the housing at the distal end, a bearing between the bearing mandrel and the housing, the bearing mandrel adapted to be connected to a housing connection box.

5. The time-controlled release device for wireline conveyed tools as claimed in claim 1 wherein the proximal end of the mandrel extends outwardly from the housing for attachment to a mandrel connection pin.

6. A time-controlled release device for wireline conveyed tools comprising:

an outer housing having a proximal end and a distal end;

a mandrel extending longitudinally through the proximal end and into the outer housing;

a disconnect housing releasably coupled to the distal end of the outer housing;

a release collet forming a portion of the outer housing at the distal end and configured to allow the outer housing to disconnect from the disconnect housing;

a disconnect release sleeve mounted on the mandrel cooperating with the release collet and configured to allow the mandrel to be disengaged from the disconnect housing;

a spring interposed between the mandrel and the outer housing;

a cylindrical pressure piston having an axial bore and slidably mounted to the mandrel, the pressure piston being disposed between the spring and a shoulder on an outer surface of the mandrel, said piston having a metering orifice therethrough, whereby when a given load is exceeded on the mandrel, the release collet is activated after a period of time dependent upon the flow resistance of the metering orifice in the piston.

7. The device according to claim 6 and further including a locking collet and sleeve surrounding the mandrel at a first location and a second biasing element surrounding the mandrel for allowing longitudinal movement of the mandrel with respect to the housing.

8. The device according to claim 6 and further including a pair of balancing pistons within the housing and mounted on the mandrel.

9. The device according to claim 6 and further including an insulated connector rod extending within the housing, a sliding contact rod received within a bore located in the distal end of the insulated connector rod, and coil connectors secured to the outer surface of the sliding contact rod.

10. A device according to claim 6 and further including a bearing mandrel located within the housing at the distal end, a bearing between the bearing mandrel and the housing, the bearing mandrel adapted to be connected to a housing connection box.

11. The device according to claim 6 wherein the housing includes a mud port housing section having a passageway allowing fluid communication between the exterior of the housing, and a chamber formed between the opposing faces of the balancing pistons within the housing.

12. The device according to claim 6 wherein a proximal end of the mandrel is connected to a mandrel connection pin, and a distal end of the disconnect housing includes a connection box.

13. The device according to claim 6 wherein a distal portion of the conductor rod is connected to a conductor barrel which has a blind bore located at a distal end of the conductor barrel, and a sliding contact rod is located for longitudinal movement within the blind bore, and at least one coil conductor mounted on the sliding contact rod for engagement with the interior surface of the blind bore of the conductor barrel.

14. The device according to claim 6 wherein a disconnect housing is removeably mounted on the distal portion of the release collet.

15. The device according to claim 14 wherein a connection box is attached to the disconnect housing, and both the disconnect housing and the connection box are left attached to the tool lodged in the well after the release collet and sleeve device is actuated.

16. The time-controlled release device for wireline conveyed tools as claimed in claim 6 wherein the proximal end of the mandrel extends outwardly from the housing for attachment to a mandrel connection pin.

17. A method of variably controlling the release of a tool from a line located in a well comprising:

positioning a release device within the well between the line and the tool, the release device including an outer housing, a mandrel mounted for axial movement within the housing, a disconnect housing, and a release mechanism coupling the outer housing to the disconnect housing;

exerting a force on the line to initiate axial movement of the mandrel;

providing a first resistance to the axial movement of the mandrel relative to the outer housing;

providing a second resistance to the axial movement of the mandrel relative to the outer housing after providing the first resistance, the first and second resistance being variable by initial selection; and increasing the force on the line to continue axial movement of the mandrel relative to the outer housing after providing the second resistance;

actuating the release mechanism after the mandrel has traveled a predetermined axial distance relative to the outer housing to disconnect the outer housing from the disconnect housing.

18. The method according to claim 17 wherein the release device also includes an indicator for signaling when the mandrel has traveled a given distance short of that necessary to trigger the release mechanism so that an operator may continue to increase the force on the line or chose to abort or suspend the process by relaxing the force on the line.

19. The method according to claim 18 wherein the first resistance is provided by a spring mechanism and the second resistance is provided by a pressure piston mounted on the mandrel and movable with the mandrel in a hydraulic chamber located within the housing, the pressure piston having a metering orifice therethrough.

20. The method according to claim 19 wherein the release tool is provided with a locking mechanism to prevent inadvertent actuation of the release mechanism.

21. The method according to claim 17 wherein the first resistance is provided by a spring mechanism and the second resistance is provided by a pressure piston mounted on the mandrel and movable with the mandrel in a hydraulic chamber located within the housing, the pressure piston having a metering orifice therethrough.

* * * * *